US008245481B1

(12) United States Patent
Flynn

(10) Patent No.: US 8,245,481 B1
(45) Date of Patent: Aug. 21, 2012

(54) APPARATUS, KIT AND METHOD FOR FORMING A DECK

(76) Inventor: Patrick O. Flynn, Bellvielle, IL (US)

( * ) Notice: Subject to any disclaimer, the term of this patent is extended or adjusted under 35 U.S.C. 154(b) by 156 days.

(21) Appl. No.: 12/765,404

(22) Filed: Apr. 22, 2010

(51) Int. Cl.

| | |
|---|---|
| ***E04G 21/00*** | (2006.01) |
| ***E01F 9/00*** | (2006.01) |
| ***E04F 11/00*** | (2006.01) |
| ***E02D 27/42*** | (2006.01) |
| ***E04B 2/30*** | (2006.01) |
| ***E04B 1/00*** | (2006.01) |

(52) U.S. Cl. ..... 52/741.11; 52/174; 52/184; 52/299; 52/483.1; 52/745.2

(58) Field of Classification Search ..... 52/299, 52/483.1, 745.19, 745.2, 741.11, 79.1, 174, 52/184

See application file for complete search history.

(56) References Cited

U.S. PATENT DOCUMENTS

| | | | | |
|---|---|---|---|---|
| 4,313,688 | A * | 2/1982 | Daniels | 403/189 |
| 4,622,792 | A * | 11/1986 | Betts | 52/263 |
| 4,823,529 | A * | 4/1989 | Canfield et al. | 52/263 |
| 5,313,756 | A * | 5/1994 | Ways et al. | 52/263 |
| 5,771,646 | A * | 6/1998 | DeSouza | 52/263 |
| 6,427,403 | B1 * | 8/2002 | Tambakis | 52/309.1 |
| 6,941,715 | B2 * | 9/2005 | Potter | 52/480 |

* cited by examiner

*Primary Examiner* — Joshua J Michener
*Assistant Examiner* — Keith Minter

(57) ABSTRACT

A method of forming a deck may comprise forming components for the deck at a first location, including forming components of a perimeter support frame for the deck to extend along a perimeter of the deck. The components of the perimeter support frame may include a plurality of perimeter frame assemblies, and forming components of an interstitial support frame for the deck to position in the perimeter support frame. The components may be transported to a location where the deck is to be used. The method may include assembling the components of the deck to form the deck at the location. The assembling step may include assembling the perimeter support frame from the perimeter frame assemblies, assembling the interstitial support frame in the perimeter support frame, and assembling decking elements on the support frames to form a floor of the deck. A kit for the deck is also disclosed.

12 Claims, 10 Drawing Sheets

APPARATUS, KIT AND METHOD FOR FORMING A DECK

BACKGROUND OF THE DISCLOSURE

Field of the Disclosure

The disclosure relates to deck assembly systems and more particularly pertains to a new apparatus, kit and method for forming a deck to facilitate fabrication of the deck components in a location remote from the final deck assembly location and to permit final assembly of the deck components without significant measuring, cutting and drilling in the field.

SUMMARY OF THE DISCLOSURE

One aspect of the disclosure relates to a method of forming a deck in an elevated condition above a ground surface is disclosed. The method comprises forming components for the deck at a first location. The step of forming may include forming components of a perimeter support frame for the deck to extend along a perimeter of the deck, and forming components of an interstitial support frame for the deck to position in the perimeter support frame. The components of the perimeter support frame may include a plurality of perimeter frame assemblies. The method further includes transporting the components to a location where the deck is to be used. The method also includes assembling the components of the deck to form the deck at the location. The step of assembling may include assembling the perimeter support frame from the perimeter frame assemblies, assembling the interstitial support frame in the perimeter support frame, and assembling decking elements on the support frames to form a floor of the deck.

In another aspect of the disclosure, a kit for forming a deck in an elevated condition above a ground surface is disclosed. The kit may comprise decking elements configured to form a floor of the deck. The kit may also include a perimeter support frame configured to support the decking elements at a perimeter area of the deck. The perimeter support frame may include a plurality of perimeter frame assemblies with a pair of side perimeter frame assemblies and at least one front frame assembly configured to form an at least partial perimeter for the deck. At least one of the frame assemblies may comprise a perimeter frame element and at least two segments of a perimeter fascia element, the segments of the perimeter fascia element being longitudinally spaced to form gaps therebetween to permit a railing support post to be positioned in one of the gaps and to be connected to the perimeter frame element. The kit may also include an interstitial support frame configured to support the decking elements at an area within the perimeter area of the deck.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The advantages and benefits of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
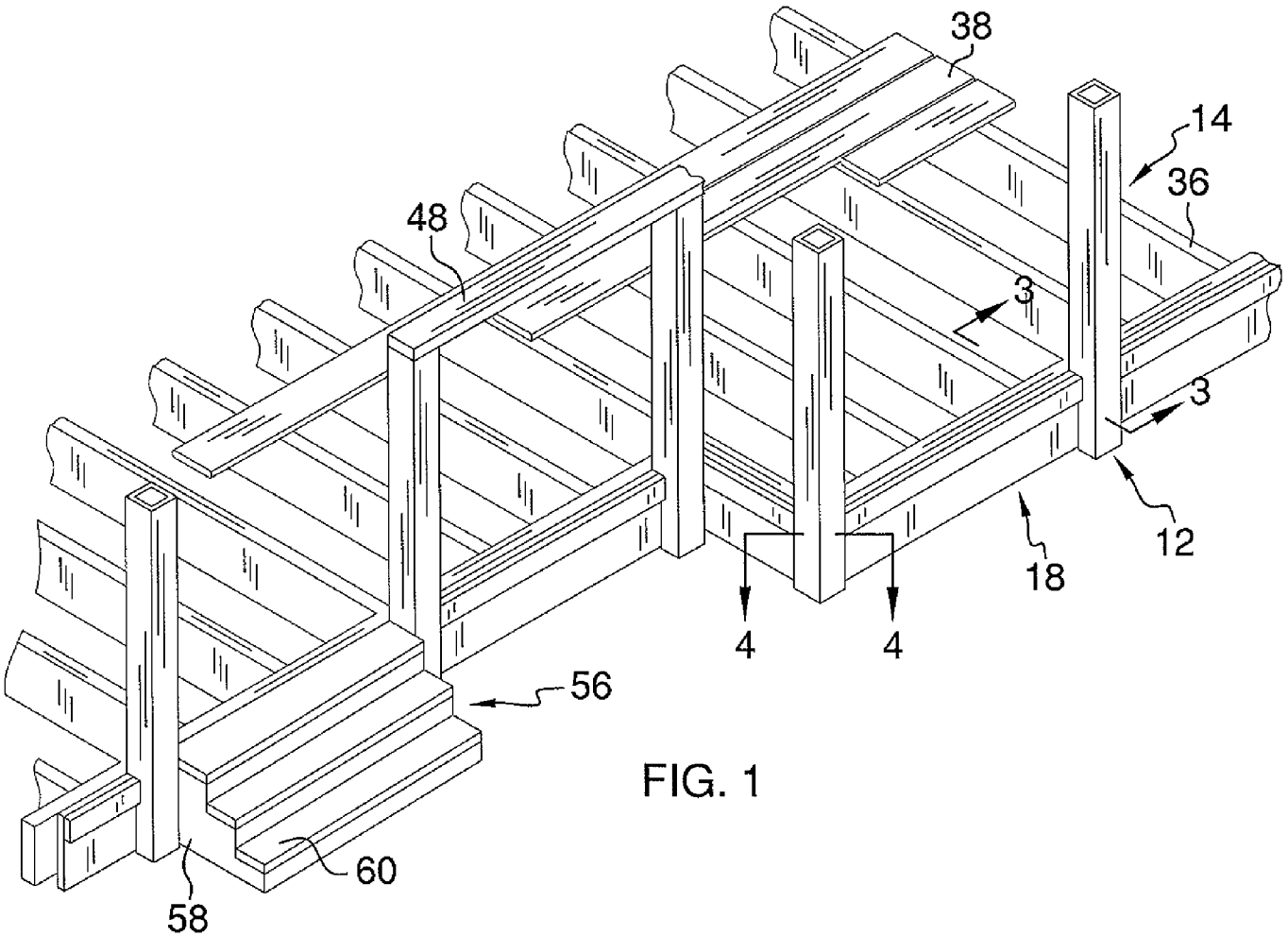
FIG. 1 is a perspective view of a portion of a partially formed deck including elements of an embodiment of the disclosure.
Figure 2:
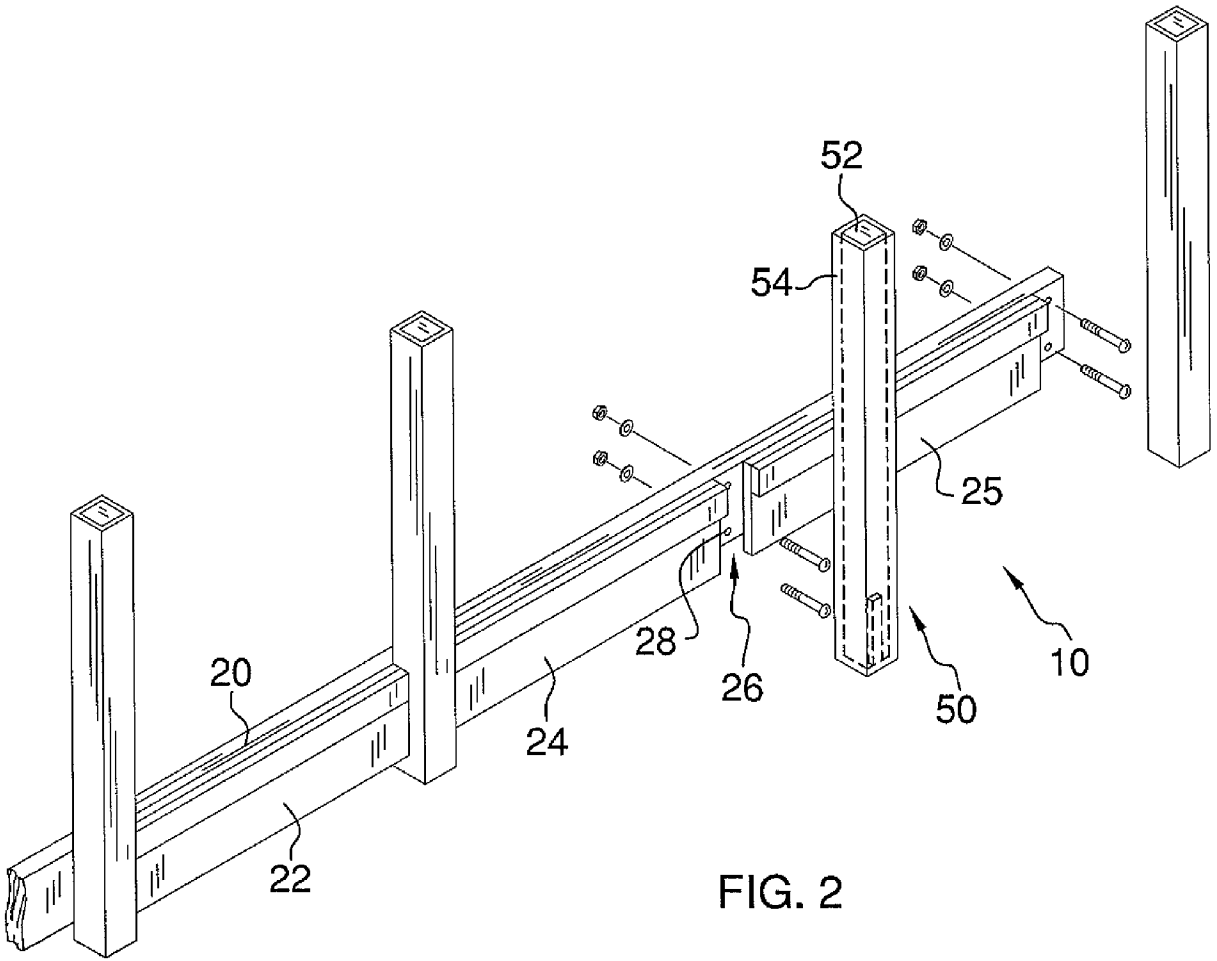
FIG. 2 is a perspective view of a portion of an embodiment of the deck showing selected elements of the deck in an exploded relationship.
Figure 3:
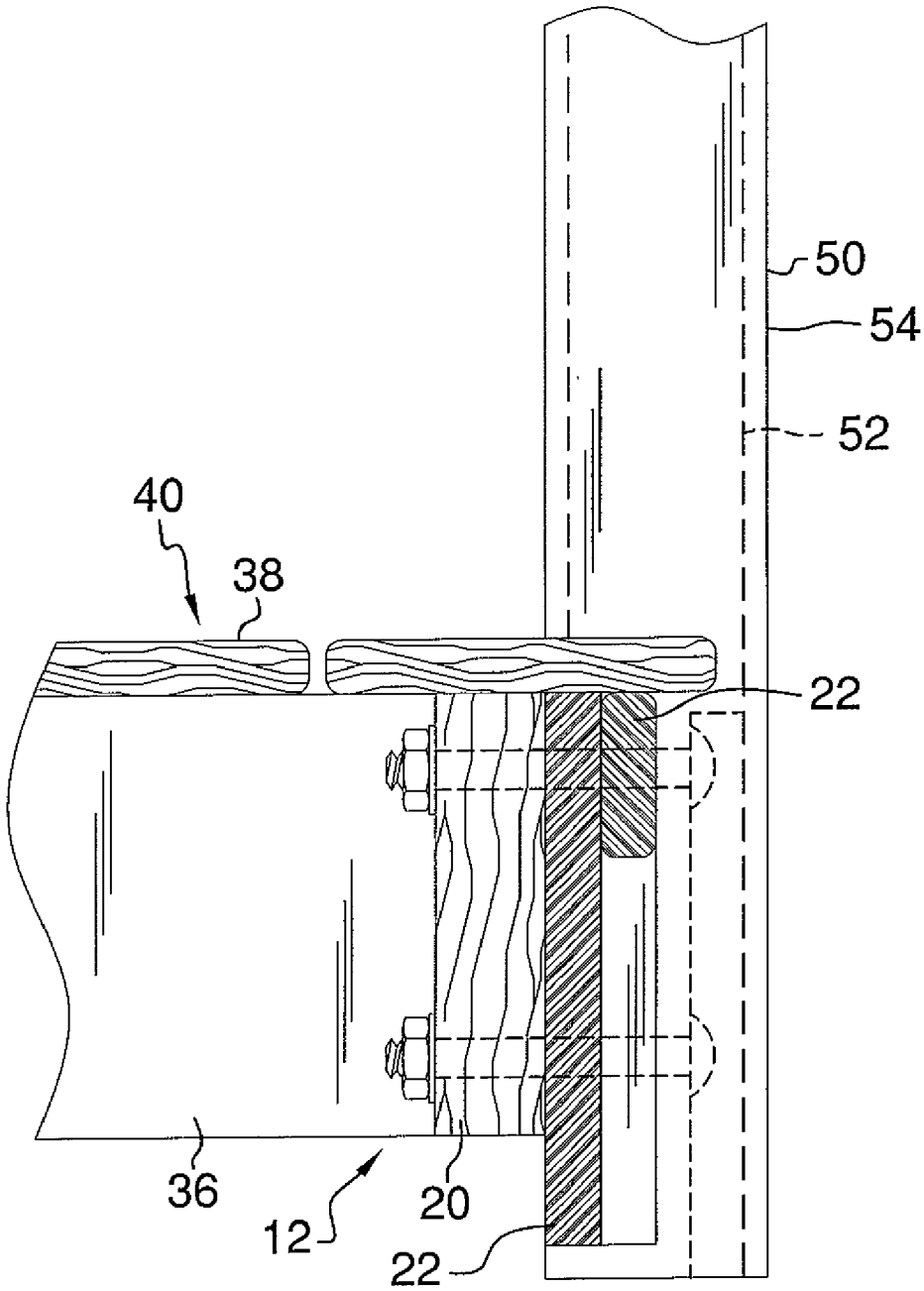
FIG. 3 is a side sectional view of a portion of an embodiment of the deck of the disclosure taken along a plane cutting through the perimeter support frame to show the relationship between components of the deck.
Figure 4:
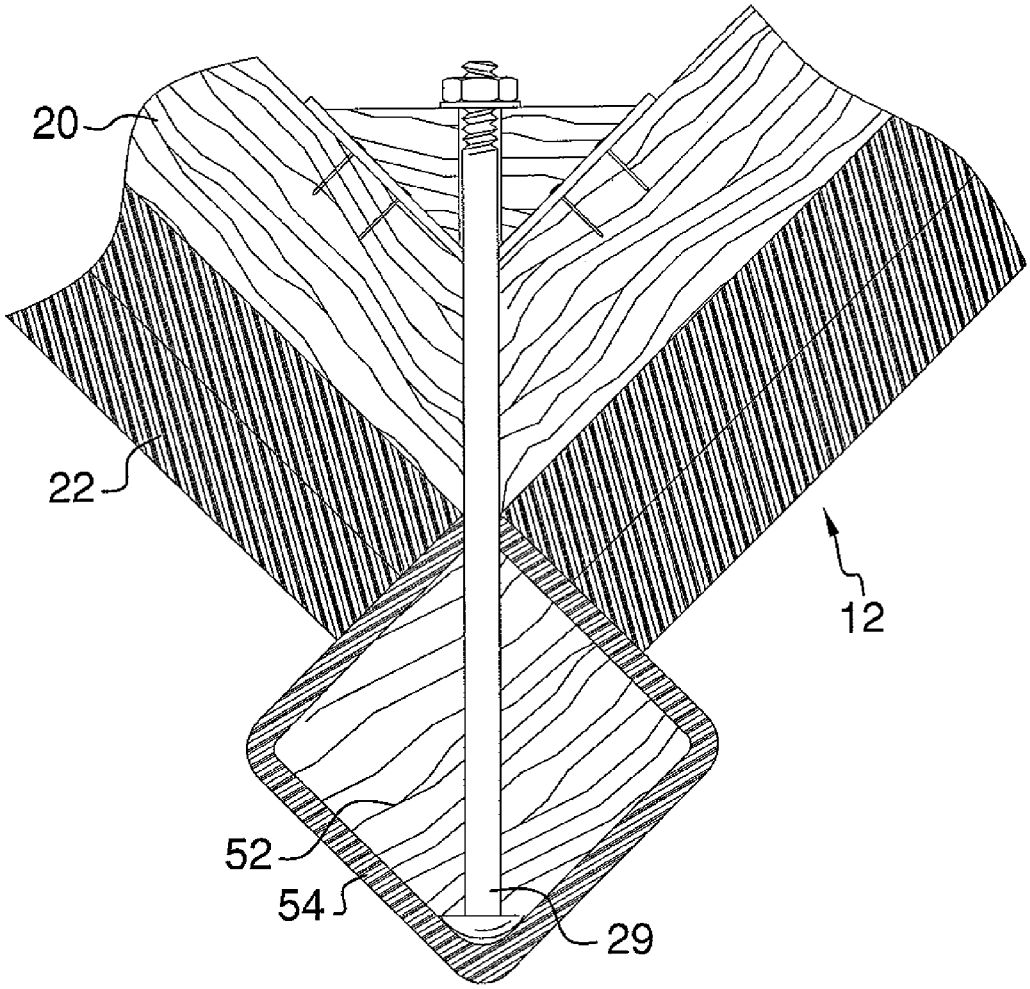
FIG. 4 is a top sectional view of an embodiment of the deck of the disclosure taken along a plane cutting through the rail support post and elements of the perimeter support frame.
Figure 5:
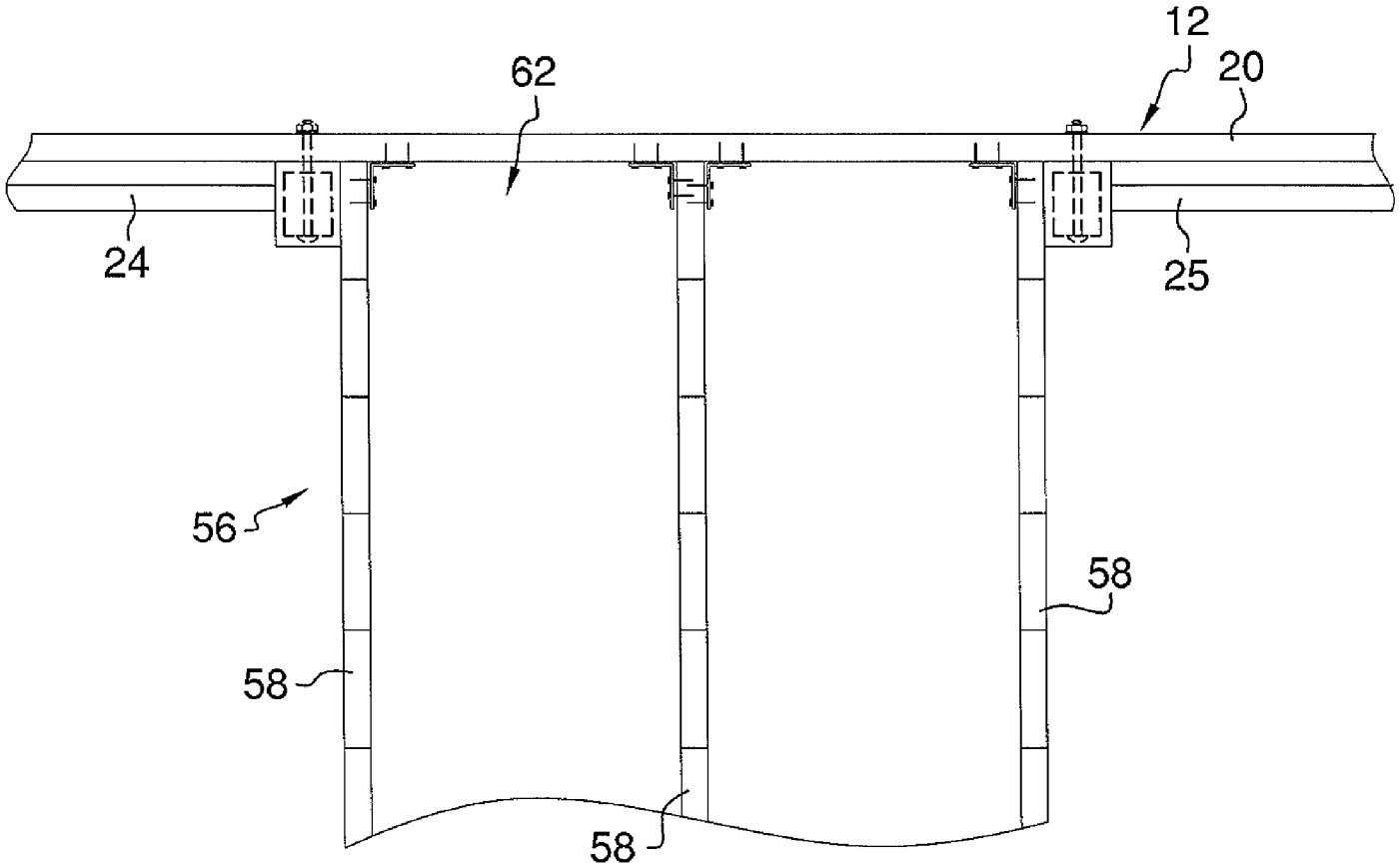
FIG. 5 is a top view of an embodiment of the deck of the disclosure showing elements of the stair support structure with stair support treads removed to show the stringer elements.

With reference now to the drawings, and in particular to FIGS. 1 through 10 thereof, a new apparatus, kit and method for forming a deck embodying the principles and concepts of an embodiment of the disclosure and generally designated by the reference numeral 10 will be described.

In one aspect of the disclosure, a deck forming kit 10 will be described. The kit is highly suitable for forming the component elements of the deck 1 at a location remote from the point of final assembly of the deck, which may be positioned, for example, adjacent to a structure 2 such as a house. The formed deck may have a front 3 and sides 4, 5. The deck may also have a rear 6 that may be connected to the structure 2, although the deck may also be freestanding as the connection of the deck to the structure is not critical.

The kit 10 may include elements of a perimeter support frame 12 and elements of an interstitial support frame 14 for forming the completed deck 1. Each of the support frames 12, 14 may be comprised of a plurality of constituent parts that may be formed at the remote location from the location of the final deck assembly and installation. The components may then be assembled at the location for the deck. Significantly, the components of the deck may be measured, cut, drilled and even pre-fitted at the remote location prior to delivery to the deck location, and assembly of the deck components may be completed with minimal measuring, cutting and drilling at the jobsite. The disclosed system enhances the ease of forming the components of the deck, as the forming can be performed in a controlled environment, utilizing jigs and techniques that would not otherwise be available at the jobsite.

The perimeter support frame 12 may include a plurality of perimeter frame assemblies that make up the perimeter support frame when assembled at the deck assembly location. Each of the perimeter frame assemblies may be elongated in shape with opposite ends and a longitudinal axis that extends through the opposite ends. The perimeter frame assemblies may include a pair of side perimeter frame assemblies 16, 17 and may also include at least one front perimeter frame assembly 18, as well as back perimeter frame assembly (not shown but optionally similar to the front perimeter frame assembly), and these frame assemblies may be assembled to form at least a partial perimeter for the finished deck 1.

In greater detail, each of the perimeter frame assemblies 16, 17 may include a perimeter frame element 20 and at least one perimeter fascia element 22 mounted on the perimeter frame element 20. The perimeter frame element 20 may form a structural support element for the respective perimeter frame assembly, and the perimeter fascia element or elements 22 may form decorative or ornamental elements for each of the perimeter frame assemblies, although these elements may also have protective and structural function. The perimeter frame element 20 and the perimeter fascia element 22 may each be elongated with opposite ends and a longitudinal axis. The perimeter frame element 20 may extend for substantially the entire length of the respective perimeter frame assembly. The perimeter fascia elements 22 may be attached to the perimeter frame element 20 so that the longitudinal axes of the perimeter fascia elements are oriented substantially parallel to the longitudinal axis of the perimeter frame element. The perimeter fascia may include more than one element, such as more than one wood or composite board.

The perimeter fascia elements may be secured to the perimeter frame element to form the respective perimeter frame assembly. The perimeter fascia may be divided into more than one segment 24, 25 that are arranged on the perimeter frame element so that the segments are longitudinally spaced from each other, and gaps 26 may be formed between the ends of adjacent spaced segments of the perimeter fascia elements. The positions of the gaps 26 between the segments 24, 25 may correspond to the desired positions of the railing support posts 50 in the finished assembly of the deck 1. The distance between the ends of the segments 24, 25 of the fascia elements 22, and thus the width of the gaps 26, may correspond to the width of one of the railing support posts. A least one, and optionally more than one, fastener receiving holes 28 through the perimeter frame element 20 may be positioned adjacent to one of the gaps 26 formed between perimeter fascia elements to receive a fasteners 29.

The deck forming kit 10 may also include a ledger member 30 for mounting on a structure 2 located adjacent to the deck to provide connection, and some degree of support, to the deck. The ledger member 30 may be sized with a length that is sufficient to extend for the entire interface between the deck and the structure.

To provide the main support to the deck from the ground, the kit 10 may include a main support beam 32 to support the perimeter support frame 12 and the interstitial support frame 14. The main support beam 32 may link the side perimeter frame assemblies 16, 17 in the assembled deck structure. One or more support posts 34 may be provided in the kit 10 for supporting the main support beam 32.

The kit 10 may also include a plurality of joist members 36 for forming the interstitial support frame 14 of the assembled deck 1. The kit 10, and the finished deck, should include a sufficient number of the joist members to support the decking elements 38 that form the floor 40 of the assembled deck. The joist members may be formed of a wood or composite material, and the decking elements may be wood or composite as well. In some preferred embodiments, the joist members are formed of treated wood, while the decking is formed of a composite material. Alternatively, wherever wood may be used for the kit 10, it may be replaced with plastic or aluminum.

Figure 6:
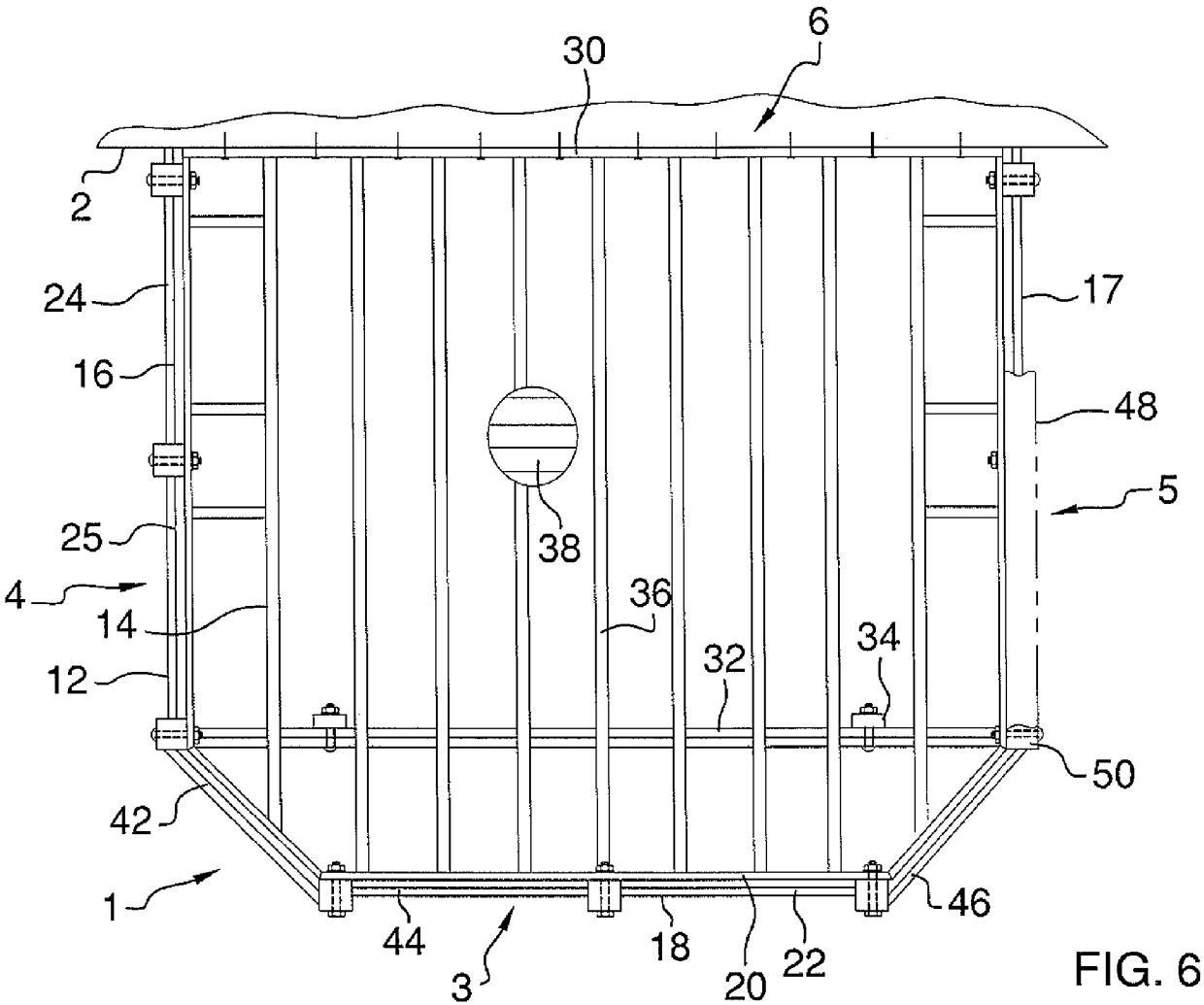
FIG. 6 is a top view of an embodiment of the deck of the disclosure showing the perimeter support frame and interstitial support frame and the rail support posts prior to the addition of decking elements to form the floor.
Figure 7:
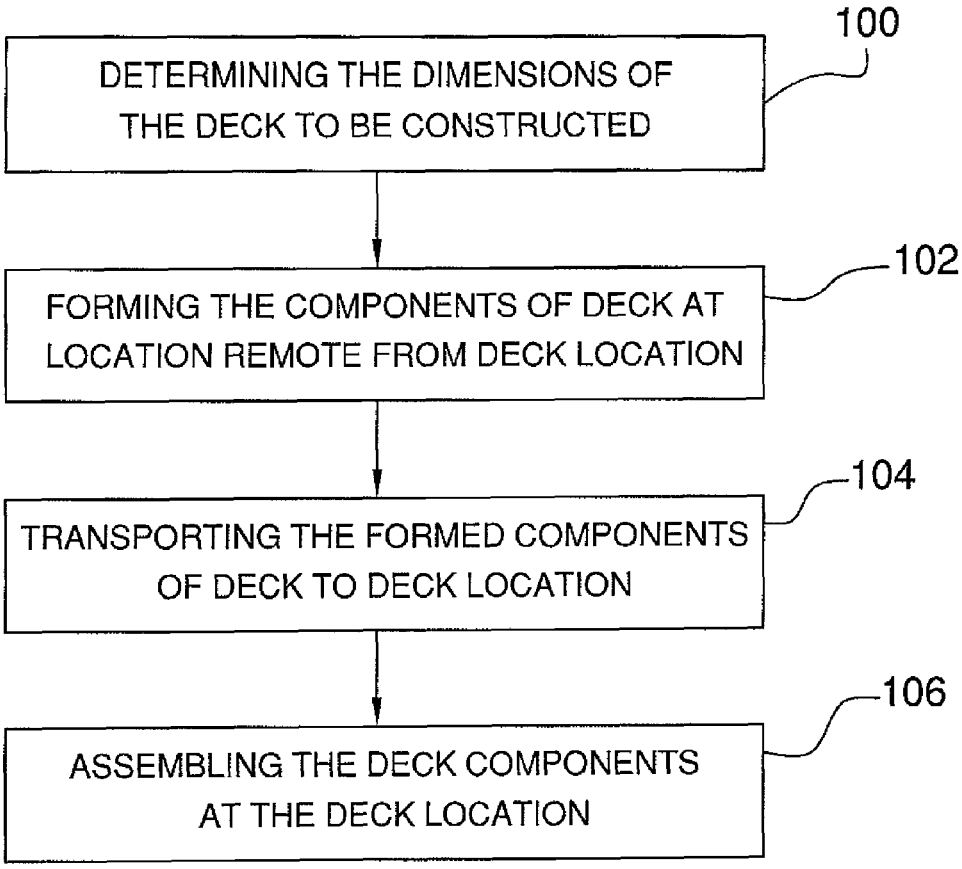
FIG. 7 is a schematic diagram of a generalized process for forming and assembling a deck according to the disclosure.
Figure 8:
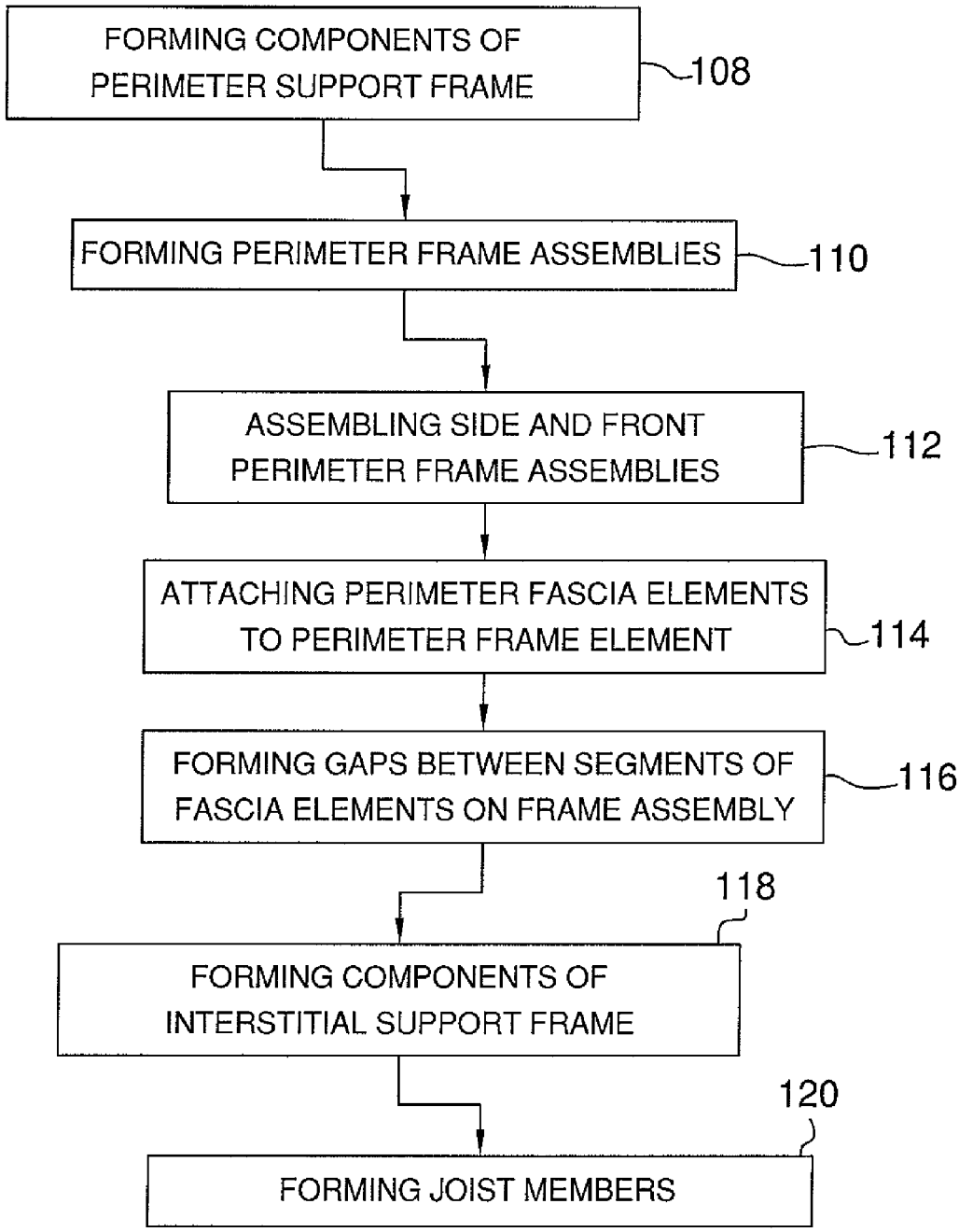
FIG. 8 is a schematic diagram of a first portion of a more detailed process for forming and assembling a deck according to the disclosure.
Figure 9:
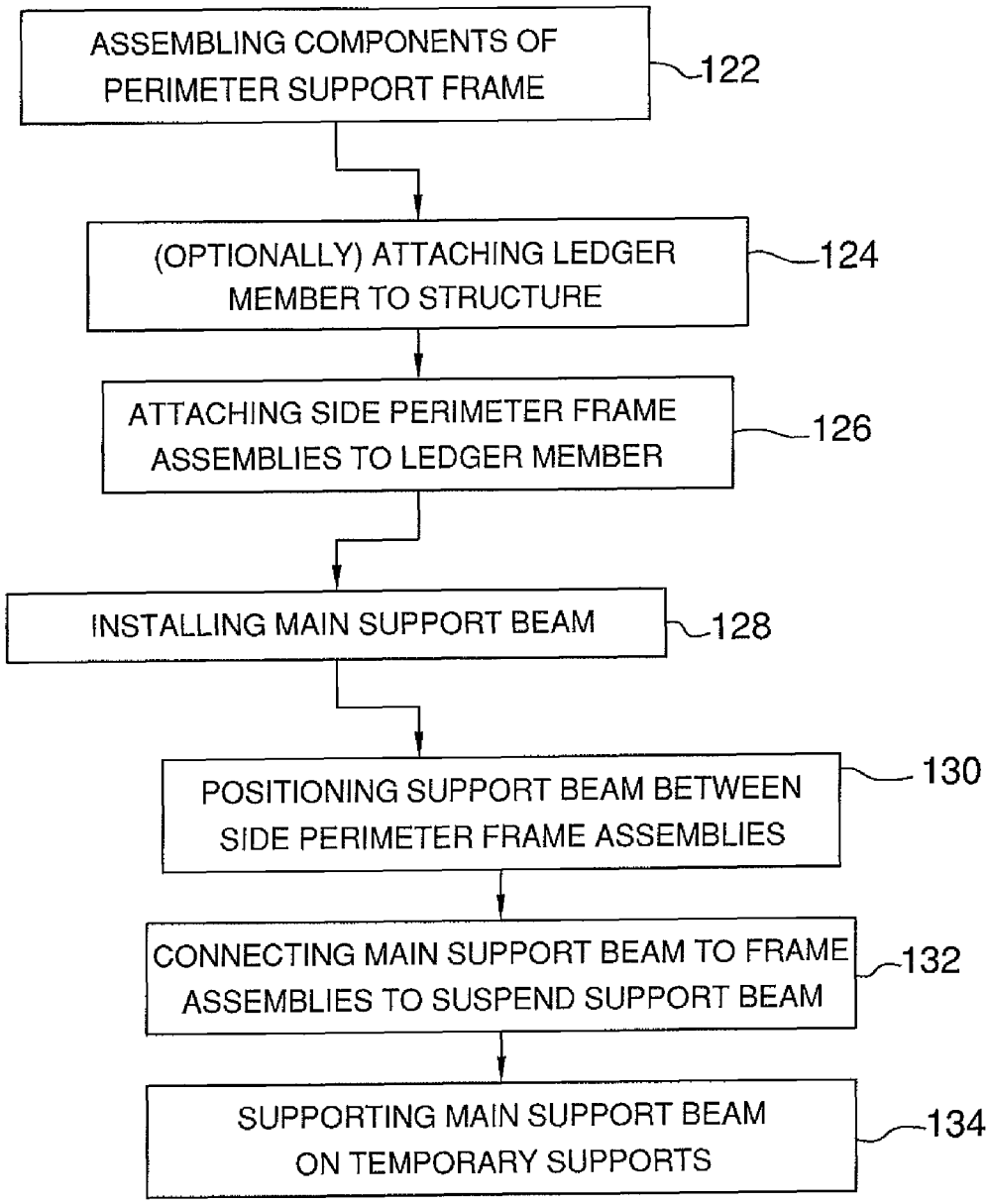
FIG. 9 is a schematic diagram of a second portion of a more detailed process for forming and assembling a deck according to the disclosure.
Figure 10:
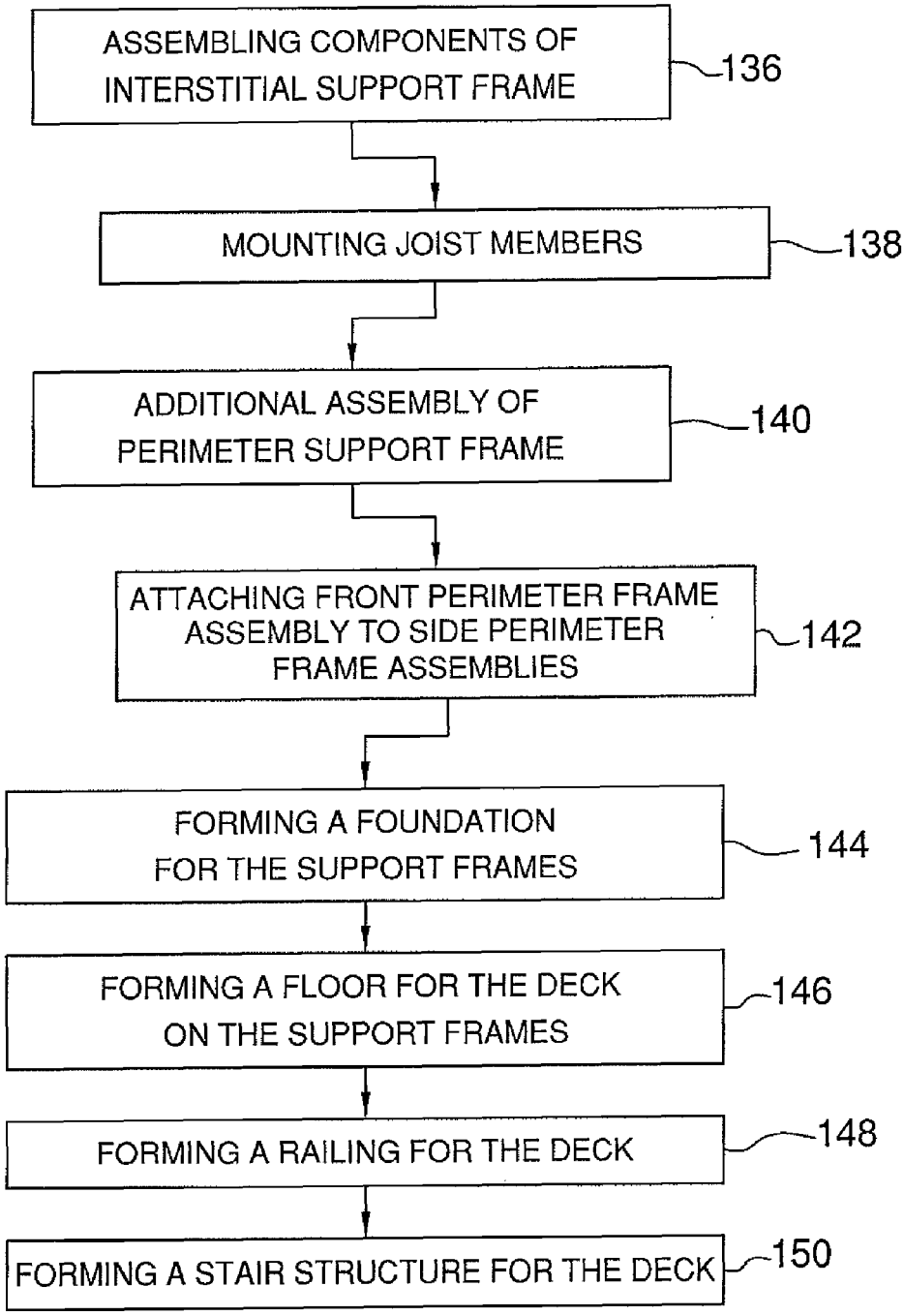
FIG. 10 is a schematic diagram of a third portion of a more detailed process for forming and assembling a deck according to the disclosure.

In some embodiments, the front perimeter frame assembly 18 may include sections 42, 44, 46 that are positioned at angles with respect to each other, such as is illustrated in FIG. 6. The front perimeter frame assembly 18 may thus include these sections 42, 44, and 46 that are pre-assembled with each other prior to delivery to the jobsite, but in many cases will be shipped with the sections detached from each other for connection at the deck assembly location. Each of the sections 42, 44, 46 may have a perimeter frame element 20 and at least one perimeter fascia elements 22. At this point it is pointed out that the gaps 26 that accept the railing support posts 50 are not necessarily located between two fascia elements or segments on the same perimeter frame element 20, as the gap may be formed between fascia elements on different and adjacent frame assemblies 16, 18, or even between fascia elements located on different sections 42, 44 of the same perimeter frame assembly.

The kit 10 may also include components to form a railing 48 for the completed deck 1 that may be supported on the perimeter support frame 12. The components for the railing may include a plurality of the rail support posts 50, which may include a core post 52 that is positioned in the interior of a sleeve 54. In some embodiments, the core post 52 is formed of a treated wood material, while the sleeve 54 is formed of a composite material. Again, however, plastic or aluminum may be used as well.

Components of a stair support structure 56 may be included in the kit 10 for forming stairs that extend from the perimeter support frame. Components of the stair support structure may include at least two stringer elements 58 for connection to the perimeter frame element 20 when the deck is assembled, and a plurality of stair treads 60 for positioning on the stringer elements 58 in the assembled deck 1.

In another aspect of the disclosure, a method of forming a deck 1 in an elevated condition above a ground surface will be described (see, e.g., FIGS. 7 through 10). In a general sense, the method may include the steps of determining the dimensions of the deck to be formed (block 100), such as by making measurements at the location for the deck, and forming the components of the deck at a location that remote from the location of the deck when assembled (block 102), which may be a manufacturing or fabrication facility where multiple kits for many different decks may be created. The components of the deck may be transported to the location for the deck to be built (block 104), and the components of the deck may be assembled into the deck 1. Typically, the assembly of the components can be accomplished with minimal measuring and cutting of the components on the jobsite.

The details of the process of determining the dimensions of the deck to be constructed (block 100) will not be further described here. The steps that may be implemented as a part of the process of forming the components of the deck (block 102) will now be described in greater detail.

The method may include forming a perimeter support frame 12 for the deck (block 108), which may occur at a location remote from the location that the deck components are ultimately assembled. The step of forming the perimeter support frame may include forming a plurality of perimeter frame assemblies (block 110) to be assembled into the perimeter support frame, and this step may further include forming one or more side perimeter frame assemblies 16, 17 and at least one front perimeter frame assembly 18 (block 112). Forming each of the perimeter frame assemblies may include providing a perimeter frame element 20 for each of the frame assemblies, and providing at least one perimeter fascia element 22. Forming the perimeter support frame 12 may also include attaching one or more segments 24, 25 of the perimeter fascia element to the perimeter frame element (block 114). The method may include forming gaps 26 between the segments 24, 25 of the perimeter fascia elements (block 116) by, for example, longitudinally spacing the segments from each other to form gaps 26 between the ends of adjacent segments of the fascia elements. The positions of the gaps 26 between segments of the perimeter fascia elements may correspond to desired positions of the railing support posts 50, and the method may further comprise forming at least one fastener receiving hole 28 in the perimeter frame element 20 so that the holes are positioned adjacent to one of the gaps 28 formed between segments of the perimeter fascia elements. A ledger member 30 may be formed also.

The process for forming the components of the deck may further include forming components of the interstitial support frame 14 (block 118), including, for example, forming joist members 36 of suitable size and length for forming the interstitial support frame 14 when assembled with the perimeter support frame 12 (block 120). Also, the method may include forming the rail support post 50, which may comprise positioning the core post 52 in the interior of the sleeve 54 for each of the support posts. Still further, in those decks that are to include a stair structure, the process of forming the components may include forming at least two stringer elements 58 with suitable dimensions for the measurements of the deck and the site for the deck, and may also include forming an enlarged gap on one of the perimeter frame assemblies between segments of the perimeter fascia elements of the perimeter frame assembly. Suitable stair treads 60 may also be fabricated for later assembly at the jobsite.

The details of the process of transporting the components of the deck to the location of the deck assembly and installation (block 104) will not be further described here. The steps that may be implemented as a part of the process of assembling the components of the deck at the jobsite (block 108) will now be described in greater detail.

The process of assembling the components of the deck may include assembling the perimeter support frame 12 (block 122) out of the components formed for the support frame 12. The process may optionally include attaching a ledger member 30 to a structure (block 124) located adjacent to the deck if such a connection is to be made between the deck and the structure, and this may comprise screwing fasteners through the ledger member into the structure to attach the ledger member on the structure. The ledger member 30 may be positioned at the rear 6 of the deck of this illustrative description, although that positioning is not critical.

The process of assembling components may further comprise attaching the side perimeter frame assemblies to the ledger member (block 126), which may include orienting the side perimeter frame assemblies in a spaced and parallel relationship to each other and substantially perpendicular to the ledger member, although such orientations are not critical to the method. The side perimeter frame assemblies 16, 17 may generally positioned at the sides 4, 5 of the deck. In some embodiments, the attachment may be made using fasteners and suitably configured brackets. The side perimeter frame assemblies may be temporarily supported in an elevated condition about the ground surface by placing temporary vertical supports on the ground surface and supporting the side perimeter frame elements on the temporary vertical supports.

The process of assembling the components of the deck may further include installing a main support beam 32 (block 128) to support the perimeter support frame 12 and the interstitial support frame 14. The main support beam 32 may be linked to the side perimeter frame assemblies 16, 17, and in some embodiments the beam 32 will extend in a substantially perpendicular orientation to the side perimeter frame assemblies, as well as being positioned below the frame assemblies 16, 17 so that the side perimeter frame assemblies rest upon the main support beam. In greater detail, installing the main support beam may include positioning the main support beam between the side perimeter frame assemblies (block 130), connecting the main support beam to the side perimeter frame assemblies (block 132) and thereby suspending the main support beam from the side perimeter frame assemblies, and supporting the main support beam on at least one temporary vertical support by positioning the temporary support on the ground surface and connecting the main support beam (block 134).

The method may further include assembling the components of the interstitial support frame 14 for the deck (block 136), and this process may include mounting the joist members 36 (block 138). The mounting of the joist members 36 may more specifically include positioning the joist members on the main support beam 32, which may include orienting the joist members in a substantially parallel relationship to the side perimeter frame assemblies 16, 17 and in a substantially perpendicular relationship to the ledger member 30, and attaching the joist members to the ledger member.

The process of assembling the components of the perimeter support frame 12 may be further advanced (block 140) by positioning the front perimeter frame assembly 18 between the side perimeter frame assemblies such that the front perimeter frame assembly spans the side perimeter frame assemblies, and attaching the including attaching the front perimeter frame assembly to the side perimeter frame assemblies (block 142), and to the interstitial support frame assembly 14 including the joist members 36.

The method may further include forming a foundation for the perimeter support frame and the interstitial support frame (block 144). In greater detail, this process may include forming a footing hole in the ground surface below the main support beam, positioning at least one support post below the main support beam with a portion of the at least one support post extending into the footing hole, forming a footing for the at least one support post below the main support beam, attaching the main support beam to the at least one support post, and removing any temporary vertical supports after support of the main support beam has been established on the at least one support post.

Assembling the components of the deck may further include forming a floor 40 for the deck 1 on the perimeter support frame 12 and on the interstitial support frame 14 (block 146). The process of forming the floor 40 may include placing decking elements 38 on the joist members 36 of the interstitial support frame, attaching the decking elements 38 to the joist members, and trimming any portions of the decking elements 38 that extend beyond the perimeter support frame.

The method may further include forming a railing 48 for the deck 1 that is supported on the perimeter support frame 12 (block 148). The process of forming the railing 48 may include positioning one of the rail support posts in one of the gaps 26 that are formed between segments of the perimeter fascia assemblies of the perimeter support frame, attaching the rail support post to the perimeter frame element using fasteners extending through the fastener receiving holes 28, and mounting a railing 48 to at least two of the rail support posts 50.

The method may also include, in those instances where the deck is to have a stair structure attached to it, assembling a stair support structure (block 150) extending from the perimeter support frame. The process of assembling the stair structure may include mounting the stair support structure to one of the perimeter frame assemblies, such as by attaching at least two stringer elements 58 to the perimeter frame element in the enlarged gap. The stringer elements may be oriented to extend outwardly from the perimeter frame element 20 away from the interstitial support frame 14. The process may further include positioning stair treads 60 on the stringer elements in a substantially horizontal orientation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A method of forming a deck in an elevated condition above a ground surface, the method comprising:

forming components for the deck at a first location, the step of forming including:

forming components of a perimeter support frame for the deck to extend along a perimeter of the deck, the components of the perimeter support frame including a plurality of perimeter frame assemblies;

forming components of an interstitial support frame for the deck to position in the perimeter support frame;

transporting the components to a location where the deck is to be used;

assembling the components of the deck to form the deck at the location, including:

assembling the perimeter support frame from the perimeter frame assemblies;

assembling the interstitial support frame in the perimeter support frame;

assembling decking elements on the support frames to form a floor of the deck;

wherein forming components of the perimeter support frame includes forming the perimeter frame assemblies with an elongated perimeter frame element and at least one perimeter fascia element mounted on the perimeter frame element; and wherein forming the perimeter frame assemblies includes mounting a plurality of segments of the at least one perimeter fascia element in a longitudinally-spaced relationship on the perimeter frame element to form gaps between ends of the perimeter fascia elements.

2. The method of claim 1 wherein forming components of the perimeter support frame includes forming a pair of side perimeter frame assemblies for positioning at sides of the deck and at least one front frame assembly for positioning in a front of the deck.

3. The method of claim 1 including positioning at least one of the gaps at a location for a railing support post of a railing and forming the gap with a width corresponding to a width of the railing support post.

4. The method of claim 3 including forming at least one fastener receiving hole through the perimeter frame element at a position adjacent to the gap formed between the segments of the perimeter fascia elements.

5. The method of claim 1 wherein assembling the components of the deck includes assembling components of a railing comprising positioning a rail support post of the railing between one of the gaps between the perimeter fascia elements.

6. The method of claim 1 wherein assembling the perimeter support frame includes attaching a ledger member onto a structure adjacent to the deck.

7. The method of claim 6 wherein assembling the perimeter support frame includes attaching the perimeter frame assemblies to the ledger member.

8. The method of claim 1 wherein assembling the components of the deck includes providing a main support beam to support the perimeter support frame and the interstitial support frame.

9. The method of claim 8 wherein linking the side perimeter frame assemblies with the main support beam includes:

positioning the main support beam between the side perimeter frame assemblies;

connecting the main support beams to the side perimeter frame assemblies;

suspending the main support beam from the side perimeter frame assemblies; and positioning at least one temporary vertical support on the ground surface to support the main support beam.

10. The method of claim 8 additionally comprising forming a foundation for the perimeter support frame and the interstitial support frame, including:

forming a footing hole in the ground surface below a main support beam;

connecting at least one support post to the main support beam and positioning a depending portion of the at least one support post in the footing hole; and forming a footing about the portion of the at least one support post in the footing hole.

11. The method of claim 1 wherein assembling the interstitial support frame includes positioning joist members in the perimeter support frame and connecting the joist members to the perimeter support frame.

12. The method of claim 1 additionally comprising:

forming a stair support structure extending from the perimeter support frame, including:

forming an enlarged gap on the one perimeter frame element between segments of the perimeter fascia element of one of the perimeter frame assemblies; and attaching at least two stringers to the perimeter frame element in the enlarged gap.

* * * * *